US007443366B2

(12) United States Patent
Choi et al.

(10) Patent No.: US 7,443,366 B2
(45) Date of Patent: Oct. 28, 2008

(54) ORGANIC ELECTROLUMINESCENT DISPLAY AND DRIVING METHOD THEREOF

(75) Inventors: Beohm-Rak Choi, Seoul (KR); Joon-Hoo Choi, Seoul (KR); Chong-Chul Chae, Seoul (KR); Woong-Kyu Min, Namyangju (KR); Kyong-Ju Shin, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 354 days.

(21) Appl. No.: 10/504,403

(22) PCT Filed: Sep. 19, 2002

(86) PCT No.: PCT/KR02/01783

§ 371 (c)(1),
(2), (4) Date: Mar. 11, 2005

(87) PCT Pub. No.: WO03/077229

PCT Pub. Date: Sep. 18, 2003

(65) Prior Publication Data

US 2005/0156829 A1 Jul. 21, 2005

(30) Foreign Application Priority Data

Mar. 8, 2002 (KR) ..... 2002-12510

(51) Int. Cl.
*G09G 3/30* (2006.01)

(52) U.S. Cl. ..... 345/76; 345/82

(58) Field of Classification Search ..... 345/60–104; 315/169.3

See application file for complete search history.

(56) References Cited

U.S. PATENT DOCUMENTS 6,229,506 B1 * 5/2001 Dawson et al. ..... 345/82
2002/0196213 A1 * 12/2002 Akimoto et al. ..... 345/82

FOREIGN PATENT DOCUMENTS

KR 1020000071301 11/2000
KR 1020010020114 3/2001
KR 1020010055654 7/2001
WO WO 98/48403 10/1998
WO WO 99/48078 9/1999

OTHER PUBLICATIONS

D Fish, N Young, M Childs, W Steer, et. al, A Comparison Of Pixel Circuits for Active Matrix Polymer/Organic LED Displays, May 2002, SID Symposium Digest Of Technical Papers vol. 32, Issue 1, pp. 968-971.*

RMA Dawson, MG Kanem Pursuit of Active Matrix Organic Light Emitting Diode Displays, Jun. 2001, SID Symposium Digest Of Technical Papers vol. 32, Issue 1, pp. 372-375.*

* cited by examiner

*Primary Examiner*—Alexander Eisen
*Assistant Examiner*—Cory A Almeida
(74) *Attorney, Agent, or Firm*—F. Chau & Associates, LLC

(57) ABSTRACT

A pixel circuit of an organic EL display includes an EL device, first and second switching devices, a driving thin film transistor, and a capacitor.

The first switching device switches data voltages applied to data lines in response to the selection signal applied to a scan line and the second switching device connects gate and drain of the driving thin film transistor in response to a compensation signal applied to a compensation line. The driving thin film transistor supplies electric current to the organic EL device in response to the data voltage inputted to a gate from the first switching device and the capacitor maintains the data voltage applied to the gate of the driving thin film transistor for a predetermined period. At this time, the characteristic deviation of the transistor is compensated by connecting the gate and the drain of the driving thin film transistor by applying the compensation signal to the compensation line before applying the data voltage, and then the data voltages are applied to the data lines after cutting off the compensation signal. In this manner, the characteristic deviation of the driving thin film transistors can be compensated.

9 Claims, 6 Drawing Sheets

ORGANIC ELECTROLUMINESCENT DISPLAY AND DRIVING METHOD THEREOF

BACKGROUND OF THE INVENTION (a) Field of the Invention

The present invention relates to an electroluminescent (referred to as "EL" hereinafter) display and driving method thereof.

(b) Description of the Related Art

An organic EL display is a display emitting light by electrically exciting a fluorescent organic material, and it displays images by voltage-driving or current-driving M×N organic luminescent cells. An organic luminous cell includes an anode (ITO), an organic thin film, and a cathode layer Metal. The organic thin film is formed of multiple-layers including an emitting layer (EML), an electron transport layer (ETL), and a hole transport layer (HTL) for improving light-emitting efficiency by balancing electrons and holes, and also includes separate an electron injecting layer (EIL) and a hole injecting layer) (HIL).

The organic luminescent cells are driven by a simple matrix (or passive matrix) type and an active matrix type using thin film transistors (TFTs). The simple matrix driving is to select cathode lines and anode lines crossing each other, while the active matrix driving to connect TFTs and capacitors to ITO pixel electrodes and to store voltages into the capacitors.

FIG. 11 is a circuit diagram of a conventional pixel circuit of a representative one of N×M pixels, for driving an organic EL device using TFTs. Referring to FIG. 11, the organic EL device OELD is connected to a driving transistor Mb for supplying light-emitting current. The amount of current driven by the driving transistor Mb is controlled by data voltage supplied through a switching transistor Ma. A capacitor C for keeping the supplied voltage for a predetermined time is connected between a source and a gate of the transistor Mb. A gate of the transistor Ma is connected to the n-th scan line, and the source thereof is connected to a data line.

Seeing an operation of a pixel with the structure, a selection signal applied to the gate of the transistor Ma turns on the transistor Ma, and then the data voltage $V_{DATA}$ is applied to the gate A of the current driving transistor Mb through the data line. Then, the current flows into the organic EL device OELD through the transistor Mb in response to the data voltage $V_{DATA}$ applied to the gate of the transistor Mb, and the organic EL device OELD emits light.

The amount of the current flowing in the organic EL device is given by Equation 1.

$$I_{OLED} = \frac{\beta}{2}(V_{GS} - V_{TH})^2 = \frac{\beta}{2}(V_{DD} - V_{DATA} - V_{TH})^2 \quad (1)$$

where $I_{OLED}$ is a current flowing in the organic EL device, $V_{GS}$ is a gate-source voltage of the transistor Mb, $V_{TH}$ is a threshold voltage of the transistor Mb, $V_{DATA}$ is a data voltage, and β is a constant.

According to Equation 1, the current supplied to the organic EL device depends on the applied data voltage $V_{DATA}$ in the pixel circuit shown in FIG. 11, and the organic EL device turns to be luminescent in response to the supplied current. Here, the applied data voltage $V_{DATA}$ has multiple values in a predetermined range.

However, the conventional pixel circuit has a drawback in that it causes the non-uniform brightness of the panel because of the characteristic deviation of the thin film transistors caused by the unevenness of manufacturing process.

To compensate for this problem, it is proposed to use additional thin film transistors in a pixel circuit. In this pixel circuit, however, a aperture ratio of the panel decreases due to the increase of the number of the thin film transistors and it takes so long time to charge the capacitor for low gray scale.

SUMMARY OF THE INVENTION

A motivation of the present invention is to provide a pixel circuit capable of compensating characteristic deviation of driving thin film transistors. Another motivation of the present invention is to reduce time required for charging a capacitor.

To achieve the above motivation, a pixel circuit of the present invention includes an additional compensation transistor.

According to one aspect of the present invention, an organic EL display includes a plurality of data lines, a plurality of scan lines, and a plurality of pixel circuits, each pixel circuit provided at a pixel area defined by two adjacent data lines and two adjacent scan lines. The data lines transmit data voltages representing image signals, the scan lines transmit selection signals, and the compensation lines transmit compensation signals.

Each pixel circuit includes an organic EL device, first and second switching devices, a first thin film transistor, and a capacitor. The organic device emits light according to the amount of the current applied thereto. The first switching device switches the data voltage applied to the data line in response to the selection signal applied to the scan line and the second switching device connects gate and drain of the first thin film transistor in response to the compensation signal applied to the compensation line. The first thin film transistor supplies electric current to the organic EL device in response to the data voltage inputted to its gate through the first switching device and the capacitor maintains the data voltage applied to the gate of the first thin film transistor for a predetermined period.

It is preferable that the compensation signal is applied before the data voltage is applied to the data line, and the data voltage is applied to the data line after the compensation signal applied to the compensation line is cut off.

Different supply voltages are applied to sources of the first thin film transistors of red, green, and blue pixels.

The pixel circuit may further include a second capacitor for uniformly maintaining the voltage applied to the gate of the first thin film transistor during the application of the data voltage and the second capacitor is preferably connected to the first capacitor in series.

Preferably, the first switching device is a second thin film transistor having three terminals, the three terminals of the second thin film transistor including a gate connected to the scan line and other two terminals connected to the data line and the capacitor, respectively, and the second switching device is a third thin film transistor having three terminals, the three terminals of the third thin film transistor including a gate connected to the compensation line and other two terminals connected to the gate and the drain of the first thin film transistor.

The first thin film transistor may be a first conduction type transistor and the second and the third thin film transistor may be second conduction type transistors. Alternatively, the first thin film transistor is a first conduction type transistor and the second and the third thin film transistors are different type transistors. Alternatively, the first to the third thin film transistors are the same type transistors.

According to another aspect of the present invention, a method for driving an organic EL display is provided. The method applies a selection signal for selecting some of a plurality of pixel circuits is applied to a scan line. A compensation signal for switching thin film transistors to connect gates and drains is applied to the pixel circuits. Next, data voltages representing image signals are applied to data lines after cutting off the compensation signal, and electric currents are supplied to organic EL devices by transmitting the applied data voltages to the gates of the thin film transistors.

At this time, the selection signal may be applied prior to the compensation signal or at the same time with the compensation signal.

DERAILED DESCRIPTION OF PREFERRED EMBODIMENTS

The present invention now will be described more fully hereinafter with reference to the accompanying drawings, in which preferred embodiments of the invention are shown. The present invention may, however, be embodied in many different forms and should not be construed as limited to the embodiments set forth herein.

Now, organic EL displays and driving methods thereof according to embodiments of the present invention will be described with reference to the accompanying drawings.

First, an organic EL display according to an embodiment of the present invention will be described with reference to FIG. 1.

Figure 1:
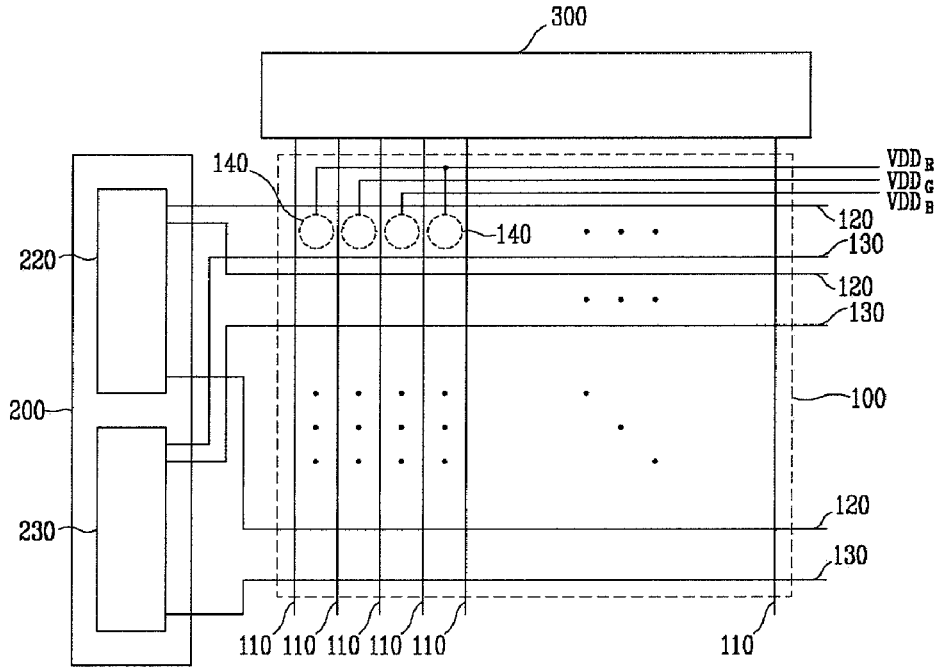
FIG. 1 is a schematic plan view of an organic EL display according to an embodiment of the present invention.

FIG. 1 is a schematic plan view of an organic EL display according to an embodiment of the present invention.

As shown in FIG. 1, the organic EL display includes an organic EL display panel 100, a scan driver 200, and a data driver 300.

The organic EL display 100 includes a plurality of data lines 110 for transmitting data voltage representing image signals, a plurality of scan lines 120 for transmitting selection signals, a plurality of compensation lines 130 for transmitting compensation signals, and a plurality of pixel circuits 140. Each pixel circuit 140 is provided on a pixel area defined by two adjacent data lines 110 and two adjacent scan lines 120. Also, different voltages $VDD_R$, $VDD_G$, and $VDD_B$ are applied to respective red (R), green (G), and blue (B) pixel circuits 140.

The scan driver 200 includes a scan driving units 220 for applying the selection signals to the scan lines 120 and another scan driving unit 230 for applying the compensation signals to the compensation lines 130. The data driver 300 applies the data voltages $V_{DATA}$ to the data lines 110.

Pixel circuits of an organic EL displace according to embodiments of the present invention will be described in detail with reference to FIGS. 2 to 10 hereinafter.

Figure 2:
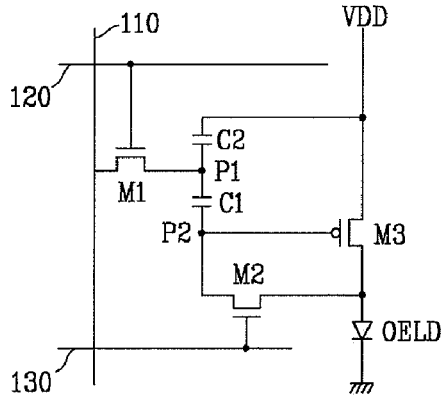
FIG. 2 is a schematic circuit diagram of a pixel circuit according to a first embodiment of the present invention.
Figure 3:
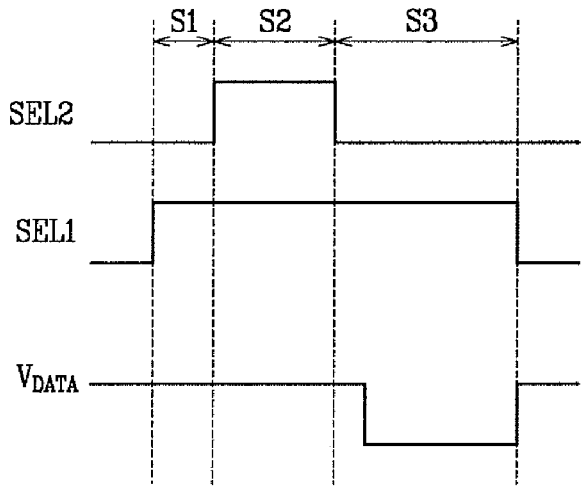
FIG. 3 is a driving-timing diagram of a pixel circuit according to the first embodiment of the present invention.
Figure 4A:
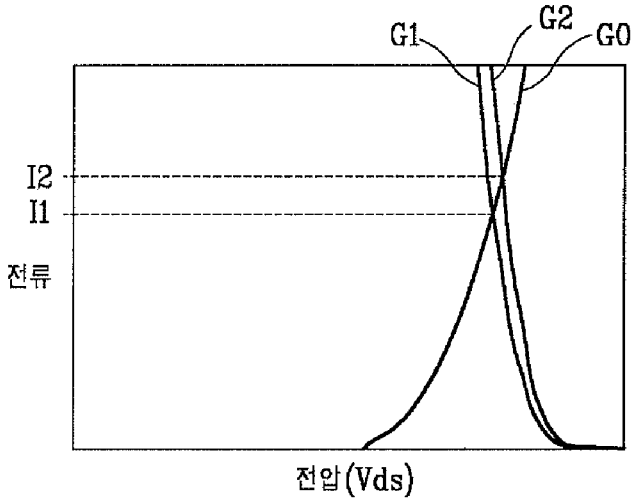
FIG. 4A is a graph illustrating current-voltage characteristic curves of a driving transistor and an organic EL device in a circuit according to the first embodiment of the present invention.
Figure 4B:
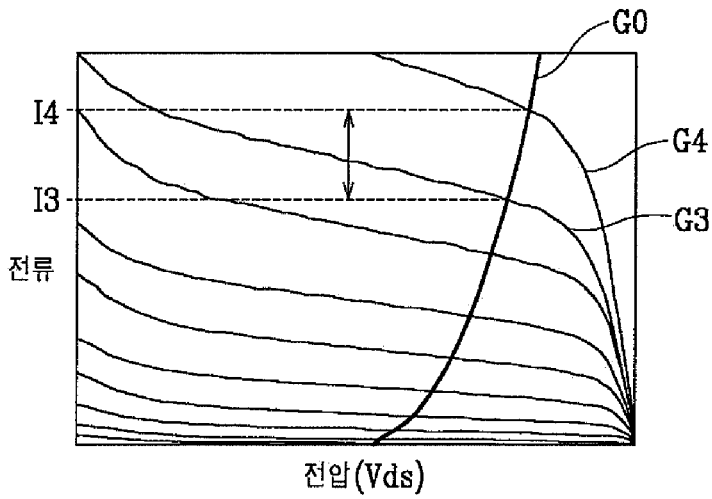
FIG. 4B is a graph illustrating current-voltage characteristic curves of a typical transistor and a typical organic EL device.

FIG. 2 is a schematic circuit diagram of a pixel circuit according to a first embodiment of the present invention, and FIG. 3 is a driving-timing diagram for the pixel circuit according to the first embodiment of the present invention. FIG. 4A is a graph illustrating current-voltage characteristic curves of a driving transistor and an organic EL device according to the first embodiment of the present invention, and FIG. 4B is a graph illustrating current-voltage characteristic curves of a typical transistor and a typical organic EL device.

As shown in FIG. 2, a pixel circuit 140 according to the first embodiment of the present invention includes an organic EL device OELD, a switching transistor M1, a compensation transistor M2, a driving transistor M3, and capacitors C1 and C2.

The organic EL device OELD emits light corresponding to the current applied thereto. The transistor M3 includes a source connected to a supply voltage VDD, a drain connected to the organic EL device OELD, and a gate supplied with data voltages from a data line, and apply the currents corresponding to the data voltages to the organic EL device OELD.

The transistor M1 includes a gate, a drain, and a source connected to a scan line 120, a data line 110, and a node P1 between the capacitors C1 and C2 and transmits the data voltages $V_{DATA}$ to the transistor M3 in response to a selection signal SEL1 applied to the scan line 120. The transistor M2 includes a drain and a gate connected to the gate and the drain of the transistor M3, respectively, and a gate connected to a compensation line 130 and compensates the characteristic of the transistor M3 in response to a compensation signal SEL2.

The capacitors C2 and C1 are connected in series between the supply voltage VDD and the gate of the transistor M2 and maintains the data voltage applied to the gate of the transistor M3 for a predetermined period. The capacitor C2 is connected between the supply voltage VDD and the drain of the transistor M1.

The operation of the pixel circuit according to the first embodiment of the present invention will be described with reference to FIGS. 3 and 4.

Referring to FIG. 3, in an initialization step S1, when the transistor M1 turns on by the selection signal SEL1 in a high level, the voltage at the node P1 is set to have an initial voltage level $V_{DATA_IN1}$ of the data voltage.

In a following compensation step S2, if the transistor M2 turns on by the compensation signal SEL2 in a high state during the turn-on of the transistor M1, the gate and the drain of the transistor M3 are connected to each other (to be in a diode connection) to perform a function of a diode. Between the supply voltage VDD and a ground, two diodes M3 and OELD are connected in series and the voltage at the node P2 becomes to have a characteristic voltage Vc determined by the characteristic of the transistor M3. Accordingly, the capacitor C1 stores a voltage difference between the node P1 and the node P2, which equals to a voltage difference ($V_{DATA_IN1}$−Vc) between the initial data voltage $V_{DATA_IN1}$ and the characteristic voltage Vc.

Since the transistor M3 in a diode connection between the gate and the drain in this compensation step S2 operates as a diode, the current-voltage characteristic curves of the transistor M3 are presented as the curves G1 and G2 in FIG. 4A, and the current-voltage characteristic curve of the organic EL device OELD is presented as the curve G0 in FIG. 4A. The driving conditions of the organic EL device OELD are determined at the cross point of the current-voltage characteristic curves of the transistor M3 and the organic EL device OELD. Accordingly, when the initial setting is performed in the compensation step, the current deviation according to the characteristic deviation of the transistor M3 is given by (I2-I1).

However, in a conventional case where the gate and the drain of the transistor M3 are not connected, the typical current-voltage characteristic curves G3 and G4 shown in FIG. 4B show large deviation depending on the voltage $V_{GS}$ between the gate and the source. The current deviation according to the characteristic deviation of the transistor M3 at the point where the driving conditions of the organic EL device OELD are determined becomes (I4-I3), which is greater than (I2-I1).

In a subsequent data voltage application step S3, the transistor M2 is cut off by setting the compensation signal SEL2 to have a low value and the data voltage is applied to drive the transistor M3. At this time, since the characteristic voltage Vc is charged in the capacitor C1 in the compensation step, the switching time of the transistor M3 decreases. If the transistor M3 is driven, electric current corresponding to the data voltage flows into the organic EL device through the transistor M3 such that the organic EL device emits light.

In the meantime, since characteristics of the organic EL devices emitting red, green, and blue lights differ from each other, the area of the transistors M3 and the voltage values of the supply voltage VDD may be independently determined for the respective R, G, and B pixels.

Even though the switching transistor M1 and the compensation transistor M2 are NMOS transistors and the driving transistor M3 is a PMOS transistor in the pixel circuit shown in FIG. 2 according to the first embodiment of the present invention, the transistors M1, M2, M3 can be replaced by other type transistors. Such embodiments will be described with reference to FIG. 5 to FIG. 10 hereinafter.

Figure 5:
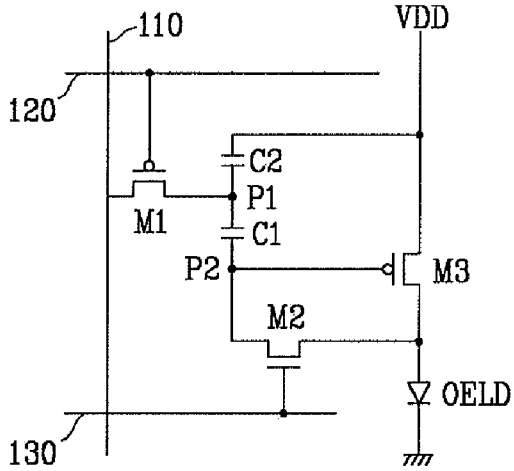
FIGS. 5, 7 and 9 are schematic circuit diagrams of pixel circuits according to second, third, and fourth embodiments of the present invention.
Figure 6:
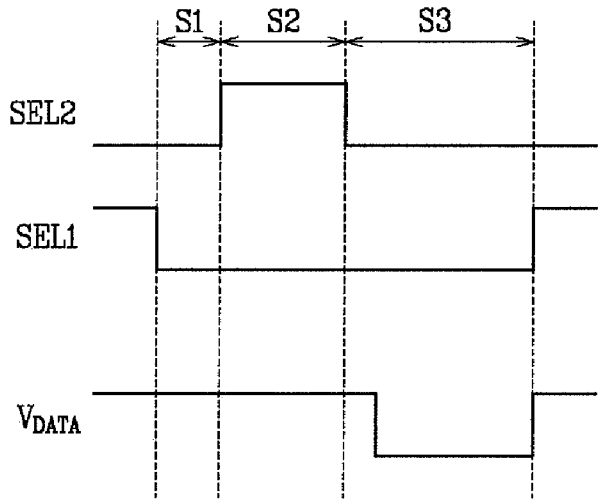
FIGS. 6, 8 and 10 are driving-timing diagrams of the pixel circuits according to the second, the third, and the fourth embodiments of the present invention.

FIG. 5 is schematic circuit diagram of a pixel circuit according to a second embodiment of the present invention and FIG. 6 is a driving-timing diagram of the pixel circuit according to the second embodiment of the present invention.

As shown in FIG. 5, a pixel circuit according to the second embodiment of the present invention is substantially identical with the pixel circuit according to the first embodiment except that the transistor M1 for supplying electric current is a PMOS transistor. The driving-timing for the pixel circuit according to the second embodiment is substantially identical with the driving timing according to the first embodiment except that the selection signal has a low value for selecting the scan line as shown in FIG. 6.

Figure 7:
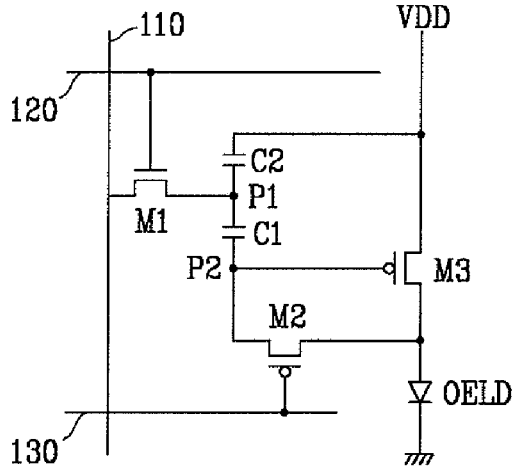
Figure 8:
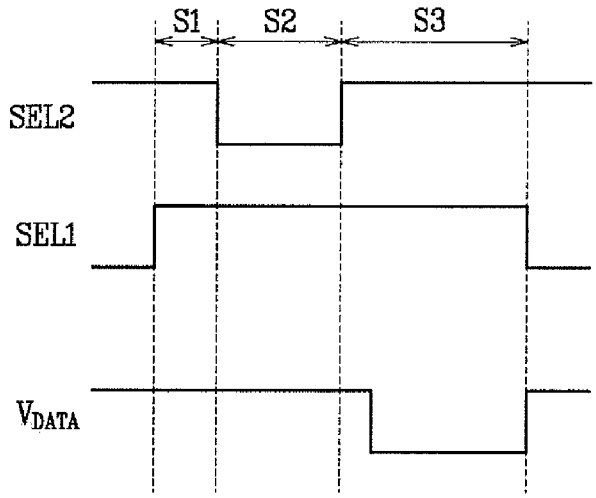

FIG. 7 is a schematic circuit diagram of the pixel circuit according to a third embodiment of the present invention and FIG. 8 is a driving-timing diagram of the pixel circuit according to the third embodiment of the present invention.

As shown in FIG. 7, a pixel circuit according to the third embodiment of the present invention is substantially identical with the pixel circuit of the first embodiment except that the compensation transistor M2 is a PMOS transistor. The driving timing of the pixel circuit according to the second embodiment, as shown in FIG. 8, is substantially identical with the driving-timing of the first embodiment except that the compensation signal has a low value for turning of the compensation transistor M2.

Figure 9:
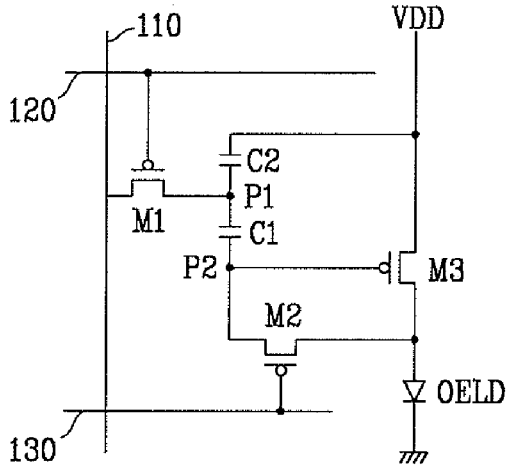
Figure 10:
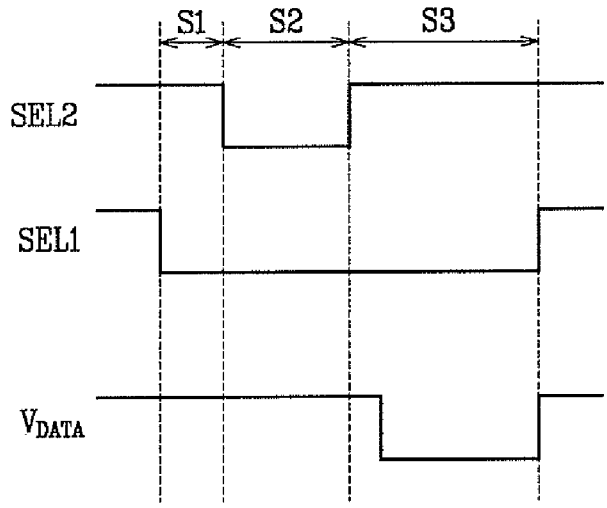
Figure 11:
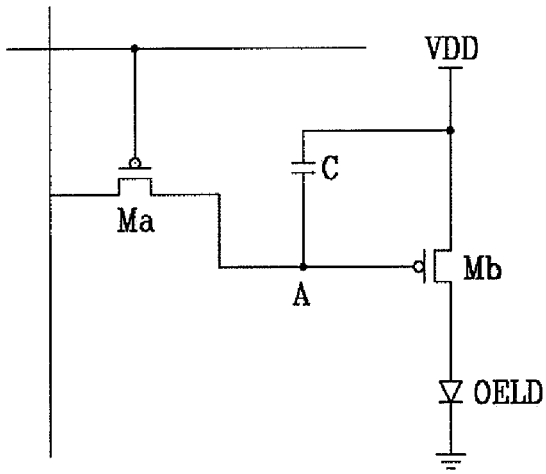
FIG. 11 is a schematic circuit diagram of a pixel circuit for a conventional organic EL display.

FIG. 9 is a schematic circuit diagram of a pixel circuit according to a fourth embodiment of the present invention and FIG. 10 is a driving-timing diagram of the pixel circuit according to the fourth embodiment of the present invention.

As shown in FIG. 9, a pixel circuit according to the fourth embodiment of the present invention is substantially identical with the pixel circuit according to the first embodiment of the present invention except that the current driving transistor M1 and the compensation transistor M2 are PMOS transistors. The driving-timing of the pixel circuit according to the fourth embodiment, as shown in FIG. 10, is substantially identical with the driving-timing of the pixel circuit according to the first embodiment except that the selection signal has a low value for selecting the scan line and the compensation signal has a low value for driving the compensation transistor M2.

The pixel circuits and driving methods thereof according to the second to the fourth embodiments will be apparent to the skilled in the art from the description of the first embodiment of the present invention with reference to FIGS. 2 to 4, and thus the description thereof will be omitted.

As described above, although the first to fourth embodiments of the present invention includes the three steps of the initialization, the compensation, and the data voltage application, the initialization step can be ignored.

Even though the driving transistor M3 in the present invention is described as a PMOS transistor, it may be an NMOS transistor. In case of using the NMOS transistor, the circuit and its driving will be apparent to the skilled in the art from the consideration of the first to fourth embodiments of the present invention, and the description thereof will be omitted.

The present invention compensates the unevenness of the brightness caused by the characteristic deviation of the driving thin film transistors and decreases the switching time because the capacitor is charged with a voltage in the compensation step.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. An organic electroluminescent (EL) display comprising:

a plurality of data lines for transmitting data voltages representing image signals;

a plurality of scan lines for transmitting selection signals;

a plurality of compensation lines for transmitting compensation signals; and a plurality of pixel circuits provided at pixel areas defined by two adjacent data lines and two adjacent scan lines, wherein each pixel circuit includes:

an organic electroluminescent device emitting light corresponding to amount of current applied thereto;

a first switching device for switching the data voltages applied to the data line in response to the selection signal applied to the scan line;

a first thin film transistor connected to a supply voltage for supplying current to the organic electroluminescent device according to the data voltage inputted to a gate thereof from the first switching device;

a second switching device for switching in response to the compensation signal applied to the compensation line such that the first thin film transistor performs a function of a diode;

a first capacitor that is connected between the gate of the first thin film transistor and a drain of the first switching device for maintaining the data voltage applied to the gate of the first thin film transistor for a predetermined period; and a second capacitor that is connected between the supply voltage and the drain of the first switching device for uniformly maintaining the voltage applied to the gate of the first thin film transistor during application of the data voltage, wherein the first capacitor and second capacitor are connected in series between the supply voltage and the gate of the first thin film transistor.

2. The organic EL display of claim 1, wherein the compensation signal is applied to the compensation line before the data voltage is applied to the data line.

3. The organic EL display of claim 2, wherein the data voltage is applied to the data line after the compensation signal applied to the compensation line is cut off.

4. The organic EL display of claim 1, wherein different levels of supply voltages are applied to the first thin film transistors of red, green, and blue pixels.

5. The organic EL display of claim 1, wherein the first switching device is a second thin film transistor having three terminals, the three terminals of the second thin film transistor including a gate connected to the scan line and other two terminals connected to the data line and the capacitor, respectively, and the second switching device is a third thin film transistor including three terminals, the three terminals of the third thin film transistor including a gate connected to the compensation line and other two terminals connected to the gate and a drain of the first thin film transistor.

6. The organic EL display of claim 5, wherein the first thin film transistor is a first conduction type transistor and the second and the third thin film transistors are second conduction type transistors.

7. The organic EL display of claim 5, wherein the second and the third thin film transistors are different conduction type transistors.

8. The organic EL display of claim 5, wherein the first to the third thin film transistors are the same conduction type transistors.

9. The organic EL display of claim 1, wherein a terminal of the first capacitor is connected to the second capacitor and the drain of the first switching device.

* * * * *